United States Patent [19]

Logan

[11] 4,251,856

[45] Feb. 17, 1981

[54] IMAGE PROJECTING DEVICE

[76] Inventor: Michael M. Logan, 96-98 Prince St., New York, N.Y. 10012

[21] Appl. No.: 40,119

[22] Filed: May 18, 1979

[51] Int. Cl.[3] ..... F21V 19/02; F21V 21/14

[52] U.S. Cl. ..... 362/232; 362/231; 362/250

[58] Field of Search ..... 362/213, 227, 230–233, 362/235–241, 249–250, 806, 228–229, 86–88, 285–289; 353/1, 121; 84/46

[56] References Cited

U.S. PATENT DOCUMENTS

| | | | |
|---|---|---|---|
| 1,780,969 | 11/1930 | Brunner | 353/121 |
| 2,072,697 | 3/1937 | Woodward | 362/250 |
| 2,134,551 | 10/1938 | Enfield | 362/250 |
| 2,173,162 | 9/1939 | Gilluly | 353/1 |
| 2,295,863 | 9/1942 | Paradis | 362/227 |
| 3,241,419 | 3/1966 | Gracy | 84/46 |
| 3,789,211 | 1/1974 | Kramer | 362/231 |
| 3,949,350 | 4/1976 | Smith | 362/86 |
| 4,025,777 | 1/1975 | Hayakawa | 362/250 |

FOREIGN PATENT DOCUMENTS

| | | | |
|---|---|---|---|
| 847131 | 8/1952 | Fed. Rep. of Germany | 362/227 |
| 675508 | 2/1930 | France | 362/232 |
| 113698 | 3/1917 | United Kingdom | 362/227 |

*Primary Examiner*—Donald A. Griffin
*Assistant Examiner*—Thomas H. Tarcza
*Attorney, Agent, or Firm*—James & Franklin

[57] ABSTRACT

A plurality of open-ended tubular members are movably mounted on a tripod-type base. Each member has a lens mounted to the front end thereof. A plurality of control rods, each independently supporting a different one of a plurality of colored or clear light sources, are located behind the lens. To permit variations in the projected image, each of the rods is individually movably mounted on a disc which is, itself, adjustably positionable within the member. The color coded rear ends of the rods and the disc position adjuster are externally accessible to permit manual positioning thereof. A flasher circuit is provided for intermittently energizing the light sources. A dimmer may also be provided to control the frequency of the light source energizations. Lights of a non-blinking variety can also be used to create stationary light patterns.

10 Claims, 3 Drawing Figures

IMAGE PROJECTING DEVICE

The present invention relates to image projecting devices and, more particularly, to a relatively simple and inexpensive device for creating and projecting light images having particularly appealing visual effects.

The formation and projection of light images is an art form which recently has obtained widespread popularity. Often employed in connection with a live or recorded musical performance, the projected light images add an additional dimension to the performance by stimulating the visual senses of the audience. To enhance the effect, the image generating device may be synchronized, either electronically or manually, with the music being performed.

Known equipment for creating visual effects by lighting variation and/or image generation has taken a variety of different forms. One common type employs a plurality of light sources, often of different colors, the energization of which may be electronically synchronized to either the magnitude or frequency of the music. Another common type comprises a translucent screen to diffuse light from different colored light sources energized in patterns which are either random, or related to the parameters of the music being performed. In another type, light images are projected by a device which utilizes a liquid medium through which light is passed to create the visual effects. By moving the liquid in various ways, the projected images are varied. Other types of devices employ strobe lights, the flashing of which may be random or synchronized. A recent development in this art has employed lasers to create complex projected light images which may be random or synchronized to the music.

The types of light creating or projecting devices referred to above are suitable for different applications and produce visual effects with varied characteristics and different degrees of esthetic merit. However, the manually actuated or controlled types, particularly those employing laser beams and the like, require an operator having substantial artistic skill in order to provide visually pleasing images. The types which create random images or are automatically synchronized with one or more parameters of the music being performed require relatively sophisticated electronics. Moreover, many of the devices require highly sophisticated and expensive light sources, such as laser beams or the like. The devices which do not require artistic skill, sophisticated electronics or expensive light sources are normally incapable of creating visual effects which are sufficiently variable in form, color, intensity and/or timing, to be esthetically interesting and pleasing enough for mass appeal.

It is, therefore, a prime object of the present invention to provide an image projecting device capable of creating and projecting controllable, but randomly changeable, light images which are sufficiently variable in form, color, intensity and/or timing, to be visually stimulating and interesting.

It is another object of the present invention to provide an image projecting device which is formed of relatively inexpensive, reliably performing components.

It is a further object of the present invention to provide an image projecting device wherein randomly changeable light patterns can be controlled in a simple manner by a relatively unskilled operator to form esthetically pleasing images.

It is still another object of the present invention to provide an image projecting device wherein the projected light images may be easily manually varied in accordance with the music being performed.

It is still another object of the present invention to provide an image projecting device which does not require sophisticated or expensive electronics to create esthetically pleasing images.

It is still another object of the present invention to provide an image projecting device which does not require expensive light sources to create esthetically pleasing images.

In accordance with the present invention, an image projecting device is provided comprising a base and a tubular member mounted on the base. A lens is mounted on one end of the member. A plurality of light sources are situated within the member. Means are provided for energizing the light sources. Means are provided for adjustably mounting the light sources on the member for independent movement relative to the lens to vary the projected image. The light source mounting means comprises: individual means for supporting each of said light sources and means, located within the member at a given distance from the lens, for mounting the individual support means to the member. The support means mounting means comprises means for permitting each of said individual support means to be independently positioned relative thereto.

The light source mounting means further comprises means for movably mounting said support means mounting means for collective movement of said light sources relative to the lens to further vary the projected image.

The support means comprises a plurality of control rods. Each of the light sources is mounted to the forward end of a different one of the control rods. The rear ends of each of the control rods is externally accessible through the open rear end of the member.

The support means mounting means comprises a plate or disc mounted within the member at a given distance from the lens. The disc has a plurality of openings therein into which the control rods are adapted to be received. By manually manipulating the control rods, the distance between each light source and the lens may be adjusted to alter the projected image.

The disc is mounted to the member in a movable manner, such as a tongue and groove connection, such that the distance between same and the lens may be altered to further vary the image. This moving connection comprises the means for movably mounting the support means mounting means for collective movement of the light sources relative to the lens.

The energizing means comprises means for intermittently energizing the light sources. The intermittent energizing means comprises a power source and a flasher circuit which may comprise a heat sensitive switch, a delay circuit or the like. Means are also provided for controlling the frequency of the intermittent energizations. The control means, in the simplest case, comprises a dimmer switch or the like which serves to vary the power to the flasher circuit thereby adjusting the frequency of blinking of the light sources.

The base preferably has a tripod configuration and may support a plurality of tubular members of the type described herein. When a number of tubular members are employed, it is preferable that same be oriented in the same general direction to create contiguous or overlapping images. When multiple tubular members are employed, separate frequency control means may be utilized for the light sources in each member. In this case, the light sources in each member can be intermittently energized at selected rates. In addition, it is preferable to have a single control means connected to control all of the energizing means simultaneously, such that the flashing of the light sources in all of the members may be varied in unison, if desired.

To the accomplishment of the above and to such other objects as may hereinafter appear, the present invention relates to an image projecting device as set forth in the following specification and recited in the annexed claims, taken together with the accompanying drawings, wherein like numerals refer to like parts, and in which:

Figure 1:
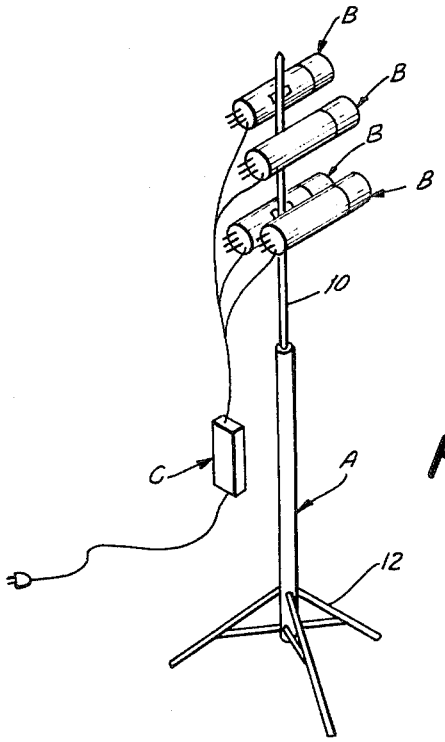
FIG. 1 is a perspective view of the image projecting device of the present invention.

As shown in FIG. 1, the image projecting device of the present invention comprises a base, generally designated A, preferably comprising a vertical telescoping member 10 from which extends a plurality of preferably collapsible legs 12. As depicted in FIG. 1, base A is a tripod of conventional design, such as is commonly utilized in the photographic industry. However it should be understood that the particular configuration of base A, in itself, constitutes no part of the present invention and that bases, supports, or tracks of many different configurations could be utilized to support the tubular members of the present invention. The tripod configuration of base A, shown in FIG. 1, is disclosed for purposes of illustration only, and is not to be construed as a limitation on the present invention.

Mounted on vertical member 10, in a position adjustable manner, are a plurality of tubular members B, the precise structure of which are disclosed in detail below. Each of the tubular members B serves to create and project a light image which may be projected on different types of surfaces, for example, a screen or the like, but is preferably created for projection on a wall or ceiling. It is preferable, although not necessary, to align all of the tubular members B in a manner which permits the images projected to be, in whole or in part, overlapping or contiguous.

The images projected by each of the tubular members B are manually variable by altering the relative positions of the light sources therein. In addition, the images projected by each of the tubular members B are electrically variable, to some extent, by control circuitry which may be wholly contained within a control circuit C, or which may be partially contained within control circuit C and partially contained within the individual tubular members B. Control circuit C is adapted to be connected to a power source, such as a conventional electrical outlet, but may also be adapted to receive power from other sources, such as battery packs or the like. Control circuit C can also be a remote control device.

Figure 2:
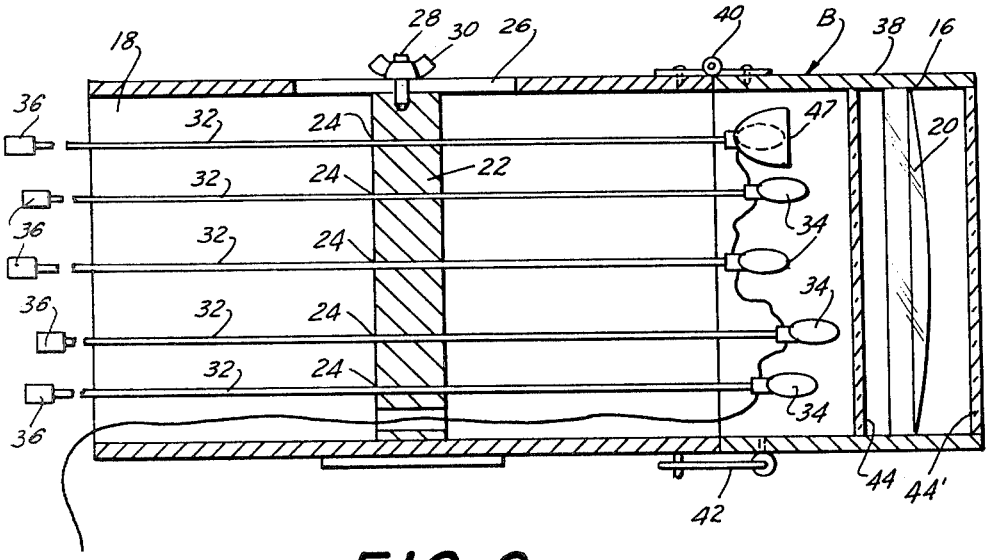
FIG. 2 is a cross-sectional view of a tubular member comprising a part of the image projecting device of the present invention.

The structure of one of the tubular members B is illustrated in FIG. 2. Member B comprises a hollow cylindrical or tubular structure 14 having an open front end 16 and an open rear end 18. Mounted within open front end 16 is a lens 20, preferably of the single or double planoconvex type or fresnel type, made of plastic or glass.

Located approximately midway between the ends of tubular member 14 is a disc or plate 22 having a plurality of substantially parallel bores or openings 24 therethrough. Openings 24 may be distributed across the surface of disc 22 in any desired manner.

The position of disc 22 along the length of tubular member 14 and, thus, the distance between disc 22 and lens 20 may be varied by movably mounting disc 22 relative to tubular member 14. This can be conveniently accomplished by providing an elongated longitudinally-directed slot 26 in the upper surface of tubular member 14. An externally threaded shaft 28 is adapted to extend from the upper portion of disc 22 through slot 26 and above the surface of tubular member 14. An internally threaded wingnut 30 or the like is received on shaft 28. Loosening wingnut 30 permits manual displacement of disc 22 within tubular member 14 within the range defined by slot 26. However, other types of clamps, such as a friction clasp or the like may also be used to accomplish this result. Variation of the position of disc 22 within tubular member 14 permits the plurality of light sources supported by disc 22 to be collectively moved with respect to lens 20.

A plurality of control rods 32 are provided, each of which is adapted to be received within a different one of the openings 24 in disc 22. At the forward end of each of the control rods 32 is mounted light source 34. The rear ends 36 of the control rods 32 extend out the open rear end of tubular member 14 so as to permit access thereto. This configuration permits individual manual adjustment of the position of each of the control rods 32 with respect to disc 22 and, thus, each of the light sources 34 with respect to lens 20.

Access to light sources 34 is provided by forming tubular member 14 with a pivotable front section 38, or removable clamp-on lens. Front section 38 of tubular member 14 is connected to the remaining portion of tubular member 14 by means of a hinge 40 which permits pivoting thereof. The parts of tubular member 14 are locked together by means of a latch 42 of any conventional configuration. Opening the front section of tubular member 14 permits easy replacement of light sources 34 and, in addition, permits the insertion of a mask 44 or light filters, reflectors or the like between the light sources 34 and the lens 20, if desired, or in front of lens 20, as shown on the figure as 44'. Masks 44 may be used to provide a particular visual effect such as defining the periphery of the projected image in a particular shape, or can be masks of various color patterns or images. Light reflector 47 or anti-reflectors can also be used as illustrated on one of the bulbs.

Light sources 34 may be any conventional light generating device. One such device which has been found to be particularly suitable for this application is what is commonly known as a "Christmas tree bulb", which has an intermittent energizing means in the form of a flasher circuit built into the base thereof. Such bulbs are quite inexpensive and are readily commercially available from a number of manufacturers in a variety of different colors or clear. Bulbs may also be painted with glass dyes or made to project certain images. The intermittent energizing circuit situated within the base of the bulb may be a heat sensitive switch or the like which will intermittently energize the bulb at a rate which is determined by the amount of power applied thereto. Thus, the frequency of flashing or blinking of the light can easily be controlled by regulating the amount of power applied to the bulb. By increasing the power applied to the bulb, the flashing frequency increases. Similarly, decreasing the power applied to the bulb decreases the frequency of flashing.

The embodiment illustrated in FIG. 2 shows the use of a plurality of "Christmas tree bulbs", all of which are connected to a single parallel circuit and all of which will flash independently at a rate determined by the amount of power applied to the circuit. Bulbs 34 may be a variety of different colors or clear. Preferably, the rear end 36 of each of the control rods 32 is provided with a colored cap, coded in accordance with the color of the bulb mounted to the front end thereof. This permits the operator of the device to distinguish particular control rods and, thus, the bulbs which are attached thereto, in order to give the operator greater facility in changing the projected image.

Figure 3:
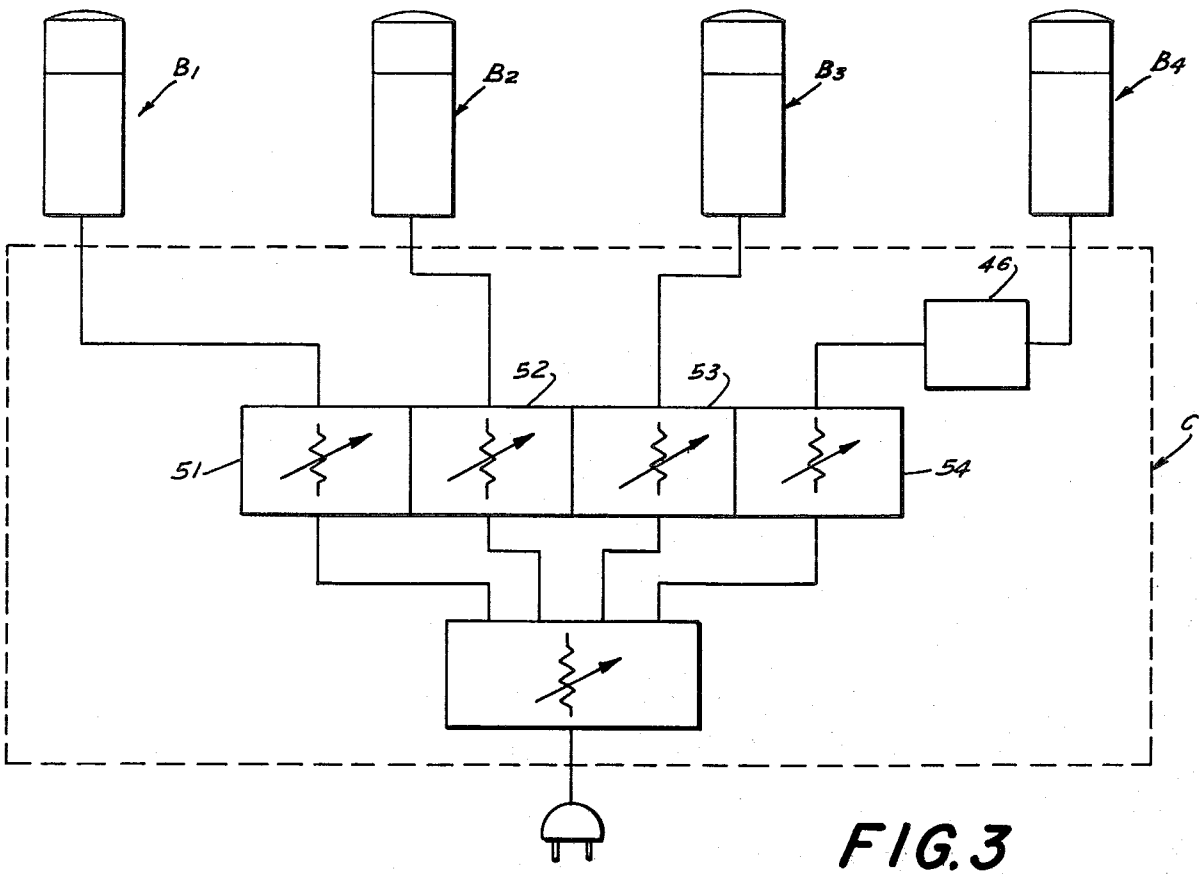
FIG. 3 is a schematic view of a typical circuit configuration for the image projecting device of the present invention.

Different types of light sources may be utilized with equal success. However, if light sources are utilized without integral flashing circuits, it is preferable to include, in the control circuitry, a separate flashing circuit such as are commercially available from a variety of different companies, including Leviton. FIG. 3 schematically illustrates the manner in which the control circuitry could be implemented.

As seen in FIG. 3, four tubular members, designated $B_1$, $B_2$, $B_3$ and $B_4$, are connected to control circuit C. Tubular members $B_1$, $B_2$, $B_3$ contain the "Christmas tree bulbs", discussed above, which have individual flashing circuits integrally mounted in the bases thereof. Thus, no additional flasher circuit is required for same. However, for illustrative purposes, a tubular member $B_4$ is included which has light sources of the non-flashing type. For this reason, a conventional flasher circuit 46 is included in control circuit C in order to provide for the blinking of the light sources in tubular member $B_4$. The lights can also be non-blinking, if desired.

Each of the tubular members $B_1$, $B_2$, $B_3$, $B_4$ is connected to a separate dimmer switch $S_1$, $S_2$, $S_3$, $S_4$, respectively, such as those which are commercially available from Lutron as Model No. LC 300CB lamp cord dimmer, or the like. Each of the dimmer switches is basically a potentiameter which can be adjusted to vary the magnitude of the power applied to the tubular member connected thereto. Variation of the power applied to the tubular member varies the flashing frequency and light intensity output of the bulbs therein. Thus, the flashing frequency and light output intensity of each of the tubular members B can be individually varied by control of one of the various dimmer switches $S_1$ through $S_4$.

Each of the dimmer switches $S_1$ through $S_4$, in turn, is connected to a master dimmer switch $S_m$ which controls the flashing frequency and light output intensity of each of the tubular members $B_1$-$B_4$ simultaneously. Thus, the operator of the device can control each of the tubular members individually, and all of the tubular members collectively, through this simple circuit configuration. Remote control devices can also be used to dim or brighten lights.

It will now be appreciated that the present invention relates to a device for projecting variable light images. The light images which are projected may be varied in several different ways. First, the manner in which each of the individual light sources affects the image projected by the tubular member within which same is mounted can be adjusted by simply adjusting the position of the control rod to which same is mounted and, thus, the distance between the bulb and the lens. In addition, the entire image may be changed by changing the position of disc 22 such that the distance between all of the bulbs and the lens is varied in unison, or by rotating disc 22 in a clockwise or counterclockwise direction. The projected image may be varied by changing the mask which is interposed between the bulbs and the lens, or the mask in front of the lens, or by changing the lens itself, or adding light reflectors.

In addition, changes in the light image may be achieved by changing the flashing frequency of the light sources. This may be done conveniently by dimmer switches connected to each of tubular members, respectively, which control the rate or frequency of flashing of the bulbs in the tubular member connected thereto. In addition, a master dimmer switch may be utilized to vary the flashing frequency and intensity of light output of all of the tubular members in unison.

It should also be appreciated that the present invention is composed of relatively inexpensive and reliably acting parts which operate in a manner which permits wide variations in the projected images without requiring a high degree of artistic skill, or sophisticated electronics. Thus, the device of the present invention is equally suitable for residential use as it is for mass appeal in art galleries and theatrical situations.

While only a single preferred embodiment of the present invention has been disclosed herein for purposes of illustration, it is obvious that many modifications or variations could be made thereto. It is intended to cover all of these variations and modifications which fall within the scope of the following claims:

I claim:

1. A device for creating a variable light image comprising a base, an open ended tubular member, means for adjustably mounting said member on said base, said member comprising forward and rear sections, a lens, means for mounting said lens to the open end of said forward section, a plurality of light sources, means for energizing said light sources, a plurality of control rods extending in a direction substantially perpendicular to said lens, each having a different one of said light sources mounted on one end thereof, the other end of each of said control rods being accessible from the open end of said rear section, a disc situated within said rear section, said disc comprising means for independently adjustably mounting each of said control rods thereon for movement along said direction, and means for movably mounting said disc to said rear section.

2. The device of claim 1, wherein said disc mounting means is externally accessible.

3. The device of claim 1, wherein said energizing means comprises means for intermittently energizing each of said light sources.

4. The device of claim 3, wherein said intermittent energizing means comprises a power source and a flasher circuit.

5. The device of claim 4, wherein said energizing means further comprises means for controlling the frequency of said intermittent energizing means.

6. The device of claim 5, wherein said control means comprises a dimmer switch operatively interposed between said power source and said flasher circuit.

7. The device of claim 1, further comprising means for pivotally connecting said forward and rear sections.

8. The device of claim 1, further comprising masks and means for mounting said mask on said forward section.

9. The device of claim 1, further comprising reflector means associated with one or more of said light sources.

10. The device of claim 1, further comprising anti-reflector means associated with one or more of said light sources.

* * * * *